US011342679B1

(12) United States Patent
Marshall et al.

(10) Patent No.: US 11,342,679 B1
(45) Date of Patent: May 24, 2022

(54) LOW PROFILE MONOCONE ANTENNA

(71) Applicant: BAE Systems Information and Electronic Systems Integration Inc., Nashua, NH (US)

(72) Inventors: John Marshall, Bedford, NH (US); William G. Collins, Hudson, NH (US); Peter J. Frappier, Litchfield, NH (US); Timothy J. McLinden, Nashua, NH (US); Robert W. Rogers, Rochester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 92 days.

(21) Appl. No.: 17/038,827

(22) Filed: Sep. 30, 2020

(51) Int. Cl.

| | |
|---|---|
| ***H01Q 13/02*** | (2006.01) |
| ***H01Q 1/42*** | (2006.01) |
| ***H01Q 1/52*** | (2006.01) |
| ***H01Q 1/50*** | (2006.01) |

(52) U.S. Cl.
CPC ..... *H01Q 13/02* (2013.01); *H01Q 1/42* (2013.01); *H01Q 1/50* (2013.01); *H01Q 1/526* (2013.01)

(58) Field of Classification Search
CPC ..... H01Q 13/02; H01Q 1/36; H01Q 1/42; H01Q 1/526; H01Q 5/50; H01Q 9/28
See application file for complete search history.

(56) References Cited

U.S. PATENT DOCUMENTS

| | | | | |
|---|---|---|---|---|
| 9,553,369 | B2 * | 1/2017 | Morin | H01Q 13/04 |
| 10,483,640 | B1 * | 11/2019 | Issa | H01Q 9/40 |
| 10,651,558 | B1 * | 5/2020 | Hand | H01Q 9/44 |
| 10,833,399 | B1 * | 11/2020 | Howarth | H01Q 9/36 |
| 2002/0109497 | A1 * | 8/2002 | Brachat | H01Q 21/205 324/95 |
| 2005/0156804 | A1 * | 7/2005 | Ratni | H01Q 9/28 343/773 |
| 2005/0184920 | A1 * | 8/2005 | Mahler | H01P 5/10 343/772 |
| 2006/0284779 | A1 * | 12/2006 | Parsche | H01Q 9/28 343/773 |
| 2011/0012802 | A1 * | 1/2011 | Weinstein | H01Q 9/40 343/772 |
| 2012/0068903 | A1 * | 3/2012 | Thevenard | H01Q 19/00 343/795 |
| 2013/0099995 | A1 * | 4/2013 | Huang | H01P 11/001 343/872 |
| 2015/0219712 | A1 * | 8/2015 | Pouzalgues | G01R 29/0878 324/702 |

(Continued)

*Primary Examiner* — Jason Crawford
(74) *Attorney, Agent, or Firm* — Sand, Sebolt & Wernow LPA

(57) ABSTRACT

A monocone antenna with an impedance matching section that may allow a reduction in physical size of the cone while maintaining similar performance as a standard monocone antenna. Alternatively, the present disclosure may provide a monocone antenna with an impedance matching section that may allow operation at a lower frequency while maintaining the same physical size as a standard monocone antenna. Further, the present disclosure may provide a monocone antenna with an impedance matching section that may allow a reduction in physical size and operation at a lower frequency relative to a standard monocone antenna.

20 Claims, 7 Drawing Sheets

(56) References Cited

U.S. PATENT DOCUMENTS

| | | | | |
|---|---|---|---|---|
| 2015/0280317 | A1* | 10/2015 | Morin | H01Q 9/28 343/795 |
| 2015/0311593 | A1* | 10/2015 | Fasenfest | H01Q 9/40 343/786 |
| 2016/0043472 | A1* | 2/2016 | Fasenfest | H01Q 1/286 343/786 |
| 2020/0206555 | A1* | 7/2020 | Yacoboski | A63B 21/00061 |

* cited by examiner

LOW PROFILE MONOCONE ANTENNA

STATEMENT OF GOVERNMENT INTEREST

This invention was made with government support under Contract No. 6534862860 awarded by a classified agency. The government has certain rights in the invention.

TECHNICAL FIELD

The present disclosure relates to a low profile monocone antenna with a lower operational frequency band than typical or alternatively a reduced size, or both. More particularly, in one example, the present disclosure relates to a low profile monocone antenna with an impedance matching section to allow for a lower frequency operational bandwidth and/or a reduced size of the monocone. Specifically, in another example, the present disclosure relates to a lower profile monocone antenna with an impedance matching section allowing for a reduction in size up to 20% and/or an operational frequency up to 16.1% lower than an identically sized but unmodified monocone antenna.

BACKGROUND

Monocone antennas are characterized by a cone-shaped extension that provides an omnidirectional radiation pattern with a wide impedance bandwidth. These antennas are used in various applications including industrial applications, military applications, commercial wireless communications, and the like, and are well suited for these implementations because of that omnidirectional radiation pattern and wide impedance bandwidth.

Typically, a monocone antenna is fed via a 50 ohm coaxial cable which provides that the low end of the operational frequency band is set by the cone height. More particularly, the height of the cone is proportional to the wavelength of the radio frequency (RF) signal being used therewith. Put another way, the lower the operational frequency being used, the larger the cone needed. In certain situations, it is desirable to reduce or lower the operational frequency which may be accomplished by increasing the height of the cone, thus increasing the size of the monocone antenna overall. It is common, however, that in many such situations, increasing the height of the cone is not possible due to physical design constraints, size constraints, and/or physical location constraints. Thus, the installation parameters of a monocone antenna often serves to define both the size of the cone that may be used and therefore the lower limit of the operational frequency available for that particular monocone antenna.

SUMMARY

The present disclosure addresses these and other issues by providing a monocone antenna with an impedance matching section that may allow a reduction in physical size of the cone while maintaining similar performance as a standard monocone antenna. Alternatively, the present disclosure may provide a monocone antenna with an impedance matching section that may allow operation at a lower frequency while maintaining the same physical size as a standard monocone antenna. Further, the present disclosure may provide a monocone antenna with an impedance matching section that may allow a reduction in physical size and operation at a lower frequency relative to a standard monocone antenna.

In one aspect, an exemplary embodiment of the present disclosure may provide a monocone antenna comprising: a coaxial cable having a center conductor, a dielectric material layer surrounding the center conductor, and a shield layer surrounding the dielectric material layer; an antenna cone connected to an end of the center conductor; a radome over the antenna cone, the radome having a first height as measured from a ground plane to a top of the radome; and a matching section with a shield layer disposed between the coaxial cable and the antenna cone and having a reduced diameter dielectric material layer with the center conductor in electrical connection with the antenna cone, the matching section having a second height. This exemplary embodiment or another exemplary embodiment may further provide wherein the first height and the second height are equal and are approximately one-quarter wavelength of an operational frequency of the monocone antenna. This exemplary embodiment or another exemplary embodiment may further provide wherein the operational frequency of the monocone antenna is lower relative to a standard monocone antenna without the matching section having same dimensions. This exemplary embodiment or another exemplary embodiment may further provide wherein the operational frequency of the monocone antenna is up to 16.1 percent lower. This exemplary embodiment or another exemplary embodiment may further provide wherein the coaxial cable has a characteristic impedance of about 50 ohms and a feed of the center conductor at the antenna cone has a characteristic impedance of about 34 ohms. This exemplary embodiment or another exemplary embodiment may further provide wherein the dielectric material layer of the coaxial cable has a first diameter and the reduced diameter dielectric material layer in the matching section has a second diameter that is approximately 30 percent smaller than the first diameter. This exemplary embodiment or another exemplary embodiment may further provide wherein the dielectric material layer of the coaxial cable and the reduced diameter dielectric material layer of the matching section are constructed of different dielectric materials. This exemplary embodiment or another exemplary embodiment may further provide wherein the first height is less than the second height and wherein the second height is approximately one-quarter wavelength of an operational frequency of the monocone antenna. This exemplary embodiment or another exemplary embodiment may further provide wherein the first height is reduced while maintaining the same operational frequency relative to a standard monocone antenna without a matching section. This exemplary embodiment or another exemplary embodiment may further provide wherein the first height is reduced by up to 20 percent. This exemplary embodiment or another exemplary embodiment may further provide wherein the coaxial cable has a characteristic impedance of 50 ohms and a feed from the matching section to the antenna cone has a characteristic impedance of about 34 ohms. This exemplary embodiment or another exemplary embodiment may further provide wherein the dielectric material layer in the coaxial cable has a first diameter and the reduced diameter dielectric layer in the matching section has a second diameter that is approximately 30 percent smaller than the first diameter. This exemplary embodiment or another exemplary embodiment may further provide wherein the dielectric material layer in the coaxial cable and the reduced diameter dielectric material layer in the matching section are constructed of different dielectric materials.

In another aspect, an exemplary embodiment of the present disclosure may provide a monocone antenna comprising: a coaxial cable having a center conductor, a dielectric material layer surrounding the center conductor, and a shield layer surrounding the dielectric material layer; an antenna cone connected to an end of the center conductor; a matching section between the coaxial cable and the antenna cone with the center conductor in electrical connection with the antenna cone and having a reduced diameter dielectric material layer and first height that is equal to one-quarter wavelength of an operational frequency of the monocone antenna; and a radome over the antenna cone, the radome having a second height as measured from a ground plane to a top of the radome, wherein the second height is less than the first height; and wherein the monocone antenna has a lower operational frequency than a standard monocone antenna. This exemplary embodiment or another exemplary embodiment may further provide wherein the second height is reduced by up to 10 percent relative to the first height. This exemplary embodiment or another exemplary embodiment may further provide wherein the operational frequency of the monocone antenna is up to 9 percent lower. This exemplary embodiment or another exemplary embodiment may further provide wherein the second height is 10 percent reduced relative to the first height and the operational frequency of the monocone antenna is approximately 9 percent lower. This exemplary embodiment or another exemplary embodiment may further provide wherein the coaxial cable has a characteristic impedance of about 50 ohms and a feed of the center conductor at the antenna cone has a characteristic impedance of about 34 ohms.

In yet another aspect, an exemplary embodiment of the present disclosure may provide a monocone antenna comprising: a coaxial cable having a center conductor, a dielectric material layer surrounding the center conductor, and a shield layer surrounding the dielectric material layer; an antenna cone connected to an end of the center conductor; a radome over the antenna cone; and a matching section having a height that is equal to one-quarter wavelength of an operational frequency of the monocone antenna and having a reduced impedance relative to an impedance of the coaxial cable. This exemplary embodiment or another exemplary embodiment may further provide wherein the coaxial cable impedance is approximately 50 ohms and the matching section impedance is approximately 34 ohms.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

DETAILED DESCRIPTION

Figure 1:
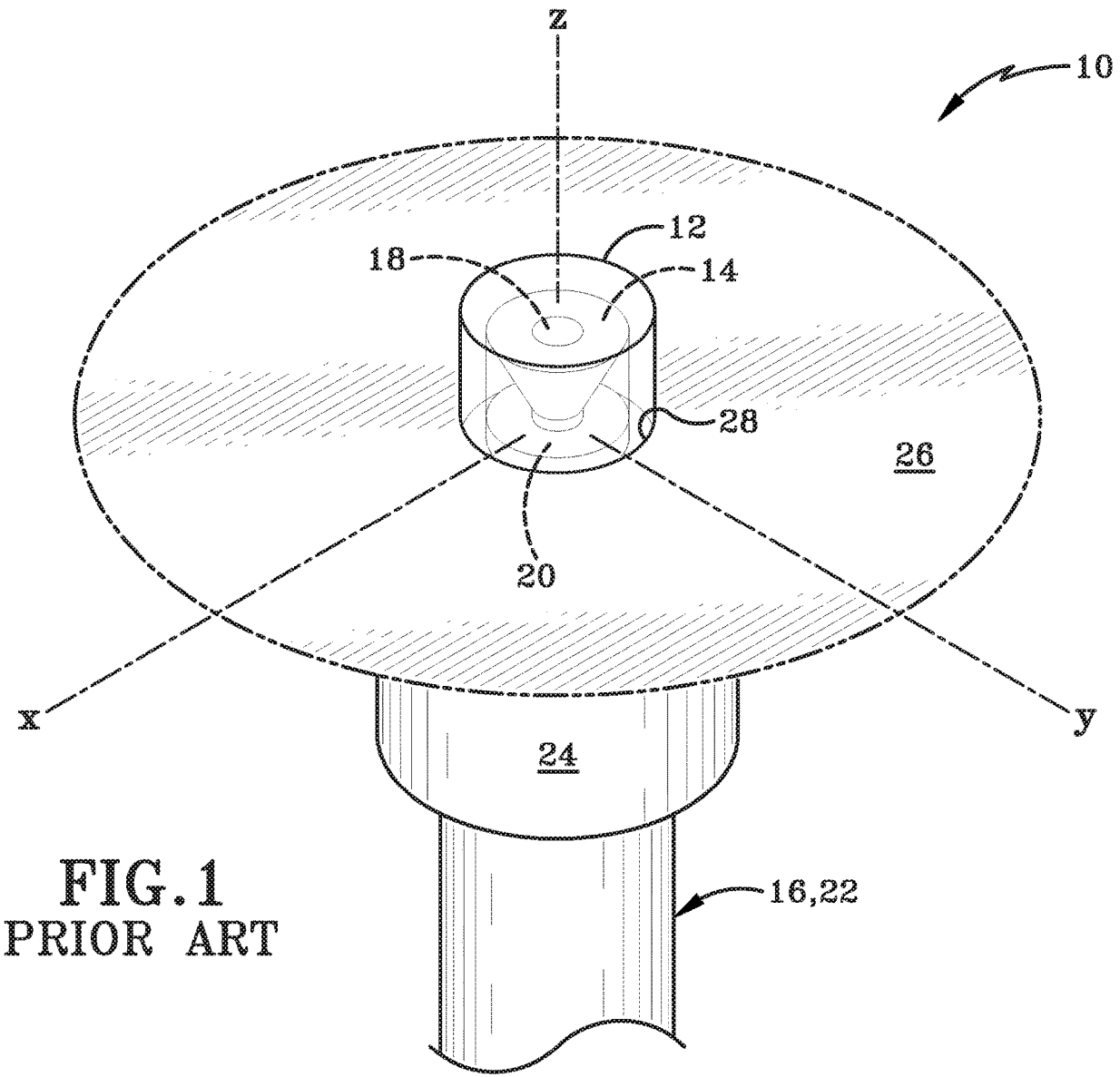
FIG. 1 PRIOR ART
FIG. 1 is a top front isometric view of a PRIOR ART example of a monocone antenna.
Figure 2B:
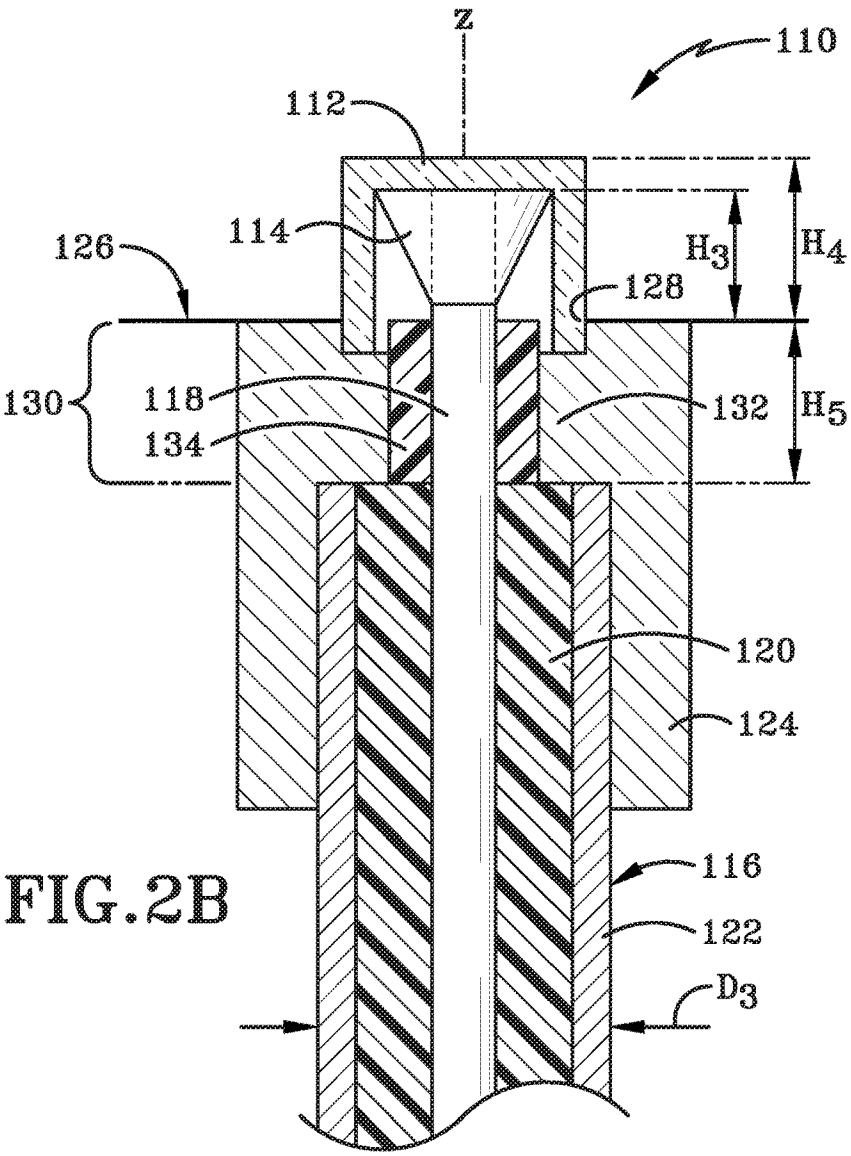
FIG. 2B is a front elevation cross-sectional view of a modified monocone antenna according to one aspect of the present disclosure.
Figure 2A:
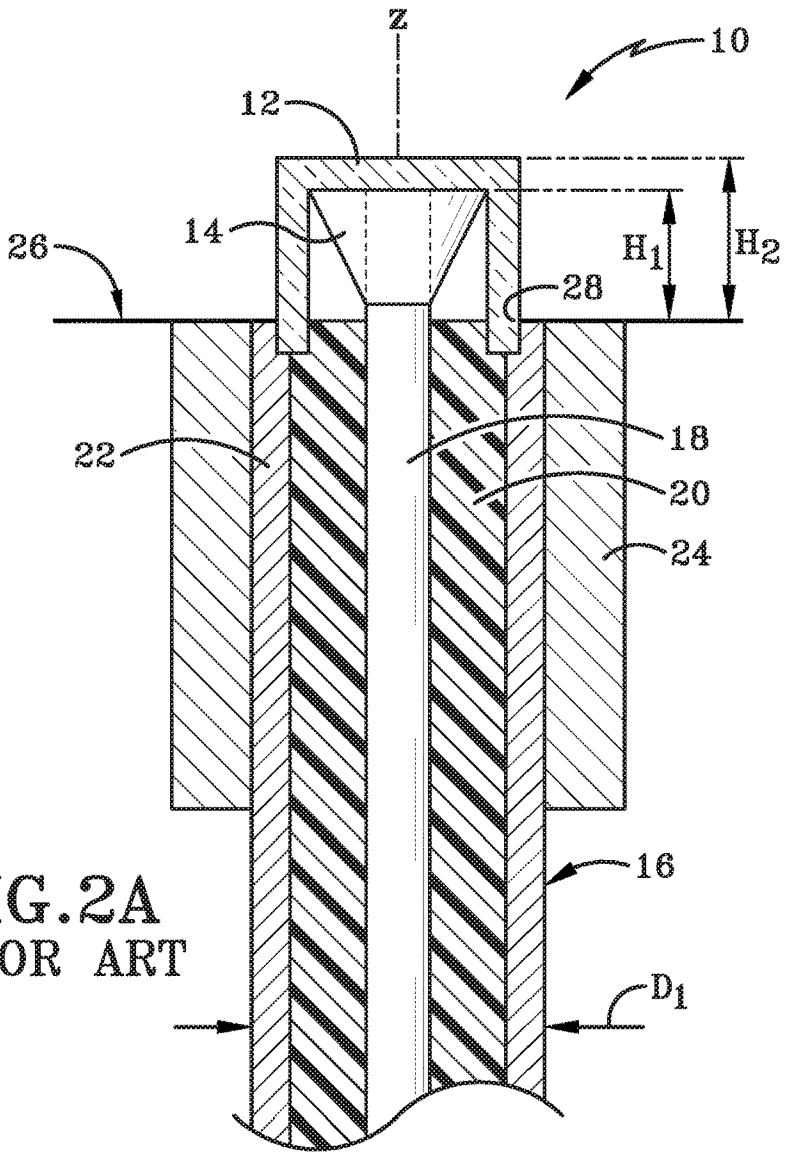
FIG.2A PRIOR ART
FIG. 2A is a front elevation cross-sectional view of the PRIOR ART monocone antenna of FIG. 1.
Figure 3B:
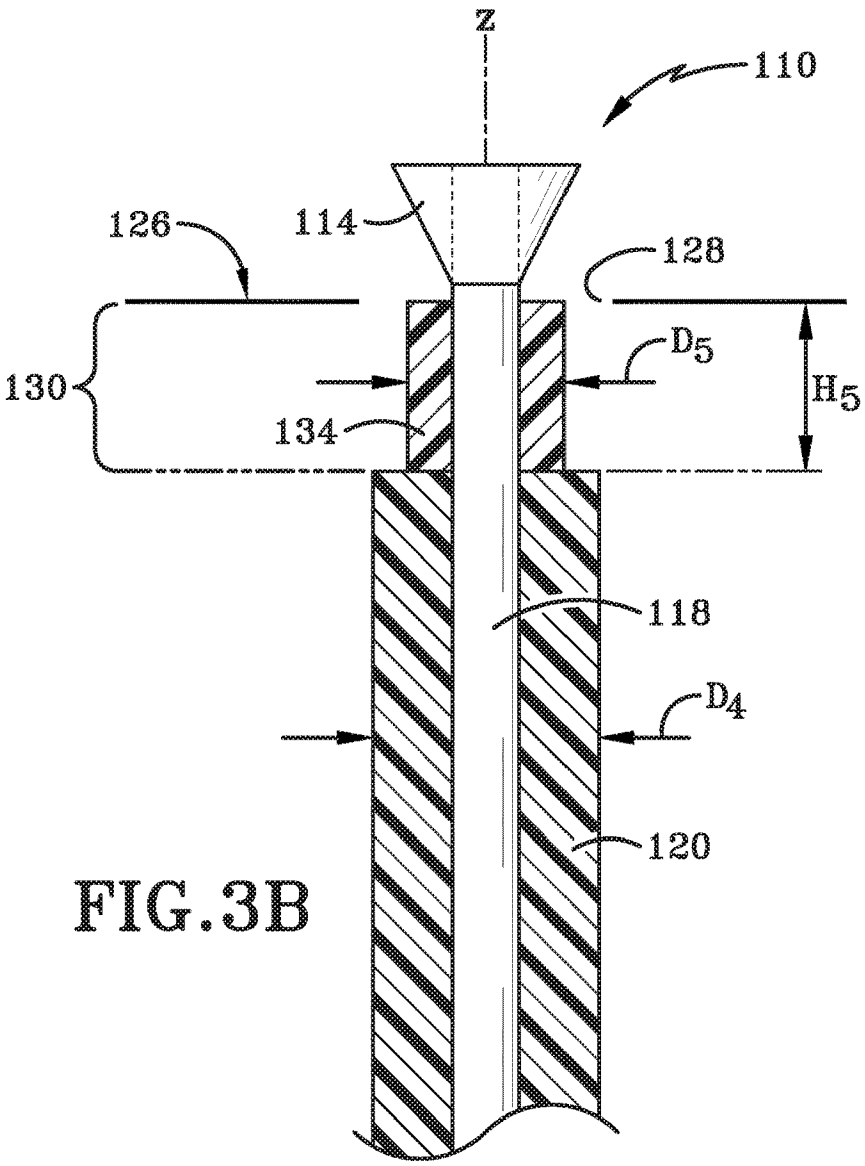
FIG. 3B is a partial front elevation cross-sectional view of the modified monocone antenna of FIG. 2B according to one aspect of the present disclosure.
Figure 3A:
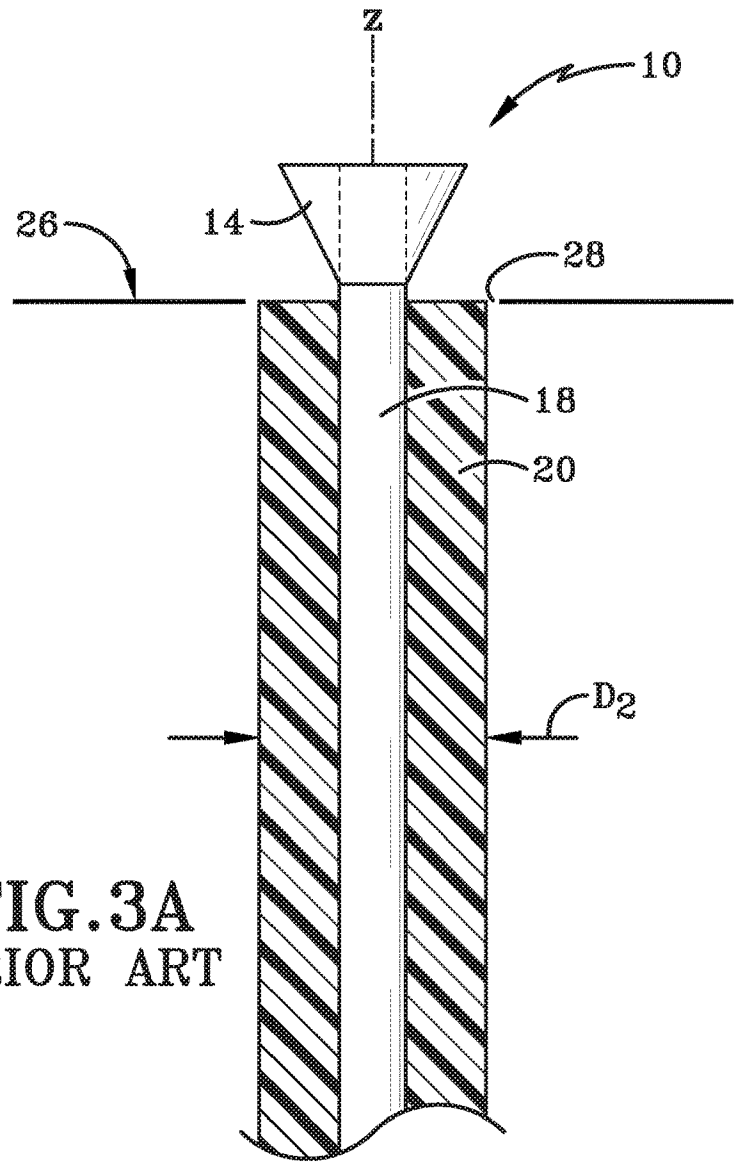
FIG. 3A PRIOR ART
FIG. 3A is a partial front elevation cross-sectional view of the PRIOR ART monocone antenna of FIG. 2A.

With reference to FIGS. 1, 2A, and 3A a PRIOR ART and generally configured standard monocone antenna is shown and generally indicated at reference 10. Monocone antenna 10 in this example includes a radome 12 which encloses or otherwise surrounds cone 14 and center conductor 18 of a coaxial cable 16. The monocone antenna further includes a dielectric material layer 20 which is part of the coaxial cable 16 and surrounds center conductor 18 as discussed further herein. Exterior of the dielectric material layer 20 is a shield layer 22, again as part of the coaxial cable 16. Monocone antenna 10 further includes a fitting 24 which allows the other components of monocone antenna 10 to be connected to a ground plane 26, as discussed further herein. The standard monocone antenna, as used herein, is understood to be a monocone antenna without a matching section (as discussed below) and is otherwise understood to be unmodified from a current monocone. The monocone antenna 10 shown in FIGS. 1, 2A, and 3A is therefore understood to be an example of a standard monocone antenna. It will be further understood that other standard and unmodified monocone antennas may be used.

Radome 12 may be a protective covering that may fit over cone 14 of antenna 10 to protect the cone 14 and other components of antenna 10 from the exterior environment. Radome 12 may be constructed of any suitable material according to the desired implementation and may further have any suitable shape appropriate therefore. For example, where antenna 10 is installed on a fast moving vehicle, such as an aircraft, radome 12 may be selected and provided to maximize the aerodynamics of antenna 10 and reduce drag cost therefrom. Where antenna 10 is installed on a stationary installation or on slower moving vehicles where aerodynamics are less important, radome 12 may be selected for maximum protection from the elements and/or may be selected based on physical size and placement restrictions dictated by the desired implementation and installation parameters. According to one aspect, radome 12 may be constructed of a radio frequency (RF) transparent material.

With reference to FIG. 2A, cone 14 may be a standard antenna monocone that may be constructed of any suitable material for the desired implementation. Typically cone 14 may include a height H1, measured from ground plane 26 to the top of cone 14, and a height H2, measured from ground plane 26 to the top of radome 12. Height H2 of the cone 10 and radome 12 is typically matched to the operational frequency of antenna 10 such that height H2 is approximately equal to one quarter of a wavelength of the desired operational frequency. This relationship is an inverse relationship such that the height H2 of cone 14 with radome 12 typically increases as the operational frequency is lowered and height H2 typically decreases as the operational frequency is raised.

Coaxial cable 16 may be a standard coaxial (coax) cable having a center conductor 18 surrounded by a dielectric material layer 20 and further surrounded by an outer shield layer 22. Center conductor 18 may be a copper wire or the like and may extend perpendicularly to ground plane 26 along the Z axis as indicated in FIG. 1. According to another aspect, center conductor 18 may be any other suitable wire or wire-type as dictated by the desired implementation. Dielectric material layer 20 may be a suitable non-conductive material operable to insulate center conductor 18 for normal use of coax cable 16. According to one aspect, dielectric material layer 20 is most typically a Teflon material. According to another aspect, dielectric material layer 20 may be any other suitable material including polymers or the like. Outer shield layer 22 may be typically formed of a shield metal such as copper or the like, according to standard operation of coaxial cable 16.

With reference to FIG. 2A, the PRIOR ART monocone antenna 10 is shown in partial cross section in that center conductor 18 and cone 14 are not sectioned; however, the other elements and components of antenna 10 are sectioned to show the relationship thereof. An example of a standard coaxial cable 16 has a typical outer diameter of 0.086 inches as indicated in FIG. 2A at arrows D1. The diameter of the dielectric material layer 20 in this standard coax cable 16 (as best seen in FIG. 3A at arrows D2 is 0.066 inches). These dimensions are discussed further below. As used and shown herein for clarity, coax cable 16 is contemplated to be a standard (i.e. unmodified) cable with an outerdiamter of 0.086 inches; however, it will be understood that the present disclosure may apply to any suitable coaxial cable with any standard (i.e. unmodified) diameter or size. By way of one non-limiting example a different standard coax cable 16 having an outer diameter of 0.141 may be used. According to another aspect, any size coaxial cable may be used provided the impedance of the matching section is appropriately reduced relative to the impedance of the coaxial cable used, as discussed further herein.

Antenna 10 may further include a fitting 24 which may be brass or other similar material that may be electrically connected to ground plane 26 and outer shield 22 of coax cable 16 while also being connected to radome 12 to secure antenna 10 to the ground plane 26 as discussed further herein.

Ground plane 26 may extend outwardly and perpendicularly relative to center conductor 18 of coax cable 16 and may be the plane on which antenna 10 is installed. For example, where antenna 10 is installed on a vehicle such as a land-based vehicle, aircraft or the like, ground plane 26 may represent an outer surface of that vehicle. By way of one non-limiting example, where monocone antenna 10 is installed on an aircraft ground plane 26 may be the outer surface of the fuselage, a wing, or other similar structure on the aircraft. Each of these components of antenna 10 may be electrically connected, typically by soldering, such that fitting 24 may be connected to ground plane 26 on one side thereof while radome 12 may extend through an aperture 28 defined through ground plane 26 and may be soldered to fitting 24. Similarly, cone 14 may be soldered to center conductor 18 of coax cable 16 while outer shield 22 of coax cable 16 may be soldered within fitting 24. According to another aspect, each of these components may be assembled or connected using any suitable technique and/or material as dictated by the desired implementation.

With reference to FIG. 2A and FIG. 2B, but with particular reference to FIG. 2B, a monocone antenna of the present disclosure is shown and generally indicated at reference 110. FIG. 2A and FIG. 2B are presented side by side to allow comparison between a PRIOR ART monocone antenna 10 and monocone antenna 110, as discussed further herein; however, monocone antenna 110 of the present disclosure will first be discussed with reference to FIG. 2B while additional comparison between FIGS. 2A and 2B will be further discussed below. A similar comparison between the antennas 10, 110 shown in FIGS. 3A (PRIOR ART) and 3B will also be discussed below.

Monocone antenna 110 may include a radome 112 and a coax cable 116. Coax cable 116 may include a center conductor 118 and a dielectric material layer 120 surrounded by an outer shield 122. Antenna 110 may further include a fitting 124 and a ground plane 126 with an aperture 128 defined therethrough. Monocone antenna 110 may further include an impedance matching section 130 (also referred to herein as matching section 130).

Radome 112 may be substantially similar or identical to radome 12 and may be selected for material, size, and/or shape according to the desired implementation and installation parameters.

Similarly, cone 114 may be substantially similar or identical to cone 14 and may be formed of any suitable material and operationally connected to center conductor 118 of coax cable 116. Cone 114 may have a height H3 defined from ground plane 126 to the top of cone 114 and a second height H4 defined from ground plane 126 to the top of radome 112. As discussed above with cone 14 and height H2, the height H4 of cone 114 with radome 112 may be approximately one quarter of a wavelength of the desired operational frequency, which is discussed further below.

Coaxial cable 116 may be substantially identical to coaxial cable 16. Specifically, coax cable 116 may include a center conductor 118 surrounded by a dielectric material layer 120 and further encapsulated in a shield layer 122. The dimensions of coax cable 116 may be substantially identical to coax cable 16 in that the overall diameter D3 of coax cable 16 may be 0.086 inches while the diameter (D4 best seen in FIG. 3B) of the dielectric material layer 120 may be 0.066 inches in diameter.

Fitting 124 may be somewhat similar to fitting 24 in that it may be brass or any other suitable material and may be operable to be electrically connected to ground plane 126 as well as to radome 112 and outer shield 122 of coax cable 116; however, fitting 124 may differ from fitting 24 in that it may be configured differently to accommodate the matching section 130 as discussed herein. Specifically, in matching section 130, fitting 124 may have a flange 132 that may surround a reduced diameter dielectric material layer 134, as discussed further herein.

As with ground plane 26, ground plane 126 may extend perpendicularly relative to center conductor 118 of coax cable 116 and may be a surface or outermost layer of the structure and/or vehicle on which antenna 110 is installed. Ground plane 126 may further include an aperture 128 defined therethrough to permit radome 112 and center conductor 118 to extend therethrough to allow these components to be attached or otherwise fixed to other components of antenna 110.

As with antenna 10, the components and elements of antenna 110 may be electrically connected via soldering or via any other suitable method and material as dictated by the desired implementation.

Impedance matching section 130, in one example, is between the coax cable 116 and the antenna cone 114. The feed end (i.e. the end of center conductor 118 that meets or is otherwise connected to cone 114) extends from the coax cable 116 through the matching section 130. The matching section 130 includes a reduced diameter dielectric material layer 134 that surrounds the center conductor 118. The physical and structural differences between a standard monocone antenna 10 without a matching section such as matching section 130 and a modified monocone antenna 110 having a matching section 130 may be best illustrated by the comparison therebetween. Therefore, with reference to FIG. 2A through FIG. 3B, side by side comparisons may be made to best illustrate impedance matching section 130.

With reference first to FIG. 2A and FIG. 2B, FIG. 2A represents a standard and unmodified monocone antenna 10 while FIG. 2B represents the monocone antenna 110 of the present disclosure having matching section 130. Matching section 130 may have a height H5 which may be substantially similar or identical to height H4, as measured from the ground plane 126 to the top of the radome 112. In other words, the height H5 of matching section 130 may be the same height as the combined height of cone 114 with radome 112, i.e. may be approximately one quarter of a wavelength of the operational frequency. This matching section 130 having a reduced diameter dielectric material layer 134 may provide distinct advantages in the operation of antenna 110 over antenna 10 as discussed further below.

With reference to FIG. 3A and FIG. 3B, the same comparison is made in that FIG. 3A represents a standard and unmodified monocone antenna 10 while FIG. 3B represents a monocone antenna 110 of the present disclosure except that both are shown with the respective radomes 12, 112, outer shield layers 22, 122 of coax cables 16, 116, and fittings 24, 124 removed for purposes of clarity. Put another way, FIG. 3A and FIG. 3B represent a relevant portion of the monocone antenna 10 and modified monocone antenna 110 of the present disclosure for purposes of comparison.

As mentioned above, the standard dielectric material layer 20 and 120 of coax cable 16 and 116, respectively, may have a diameter of 0.066 inches indicated at diameters D2 and D4, respectively. In standard and normal operation of coax cable such as coax cable 16, having a dielectric material layer 120 with a diameter of 0.066 inches, results in a coax cable capable of producing a 50 ohm feed. Put another way, a standard coax cable of these dimensions has a characteristic impedance of 50 ohms at the antenna feed, i.e. where the coax cable 16 connects to cone 14. By comparison, impedance matching section 130 may include a reduced diameter dielectric material layer 134 with a height H5 equal to the combined height of cone 114 and radome 112 (H4), wherein the diameter of the dielectric material layer 134 may be reduced to 0.046 inches (representing an approximately 30 percent reduction in size). This matching section 130 may then provide a modified feed having an impedance that is reduced relative to the impedance of the coax cable 116. While it is recognized that any reduction of the feed impedance from the 50 ohm impedance of the coax cable 116 will provide some of the benefits described herein, an exemplary feed impedance of 34 ohms is used and discussed further herein, as 34 ohms is found to be an optimal impedance to realize the maximum benefits of lower operational frequency, reduced physical size, or both, as discussed below. It will be understood, however, that any reduced feed impedance below 50 ohms may provide some similar benefits, although to a different or lesser extent than what is shown herein relative to a 34 ohm feed impedance. In other words, the impedance of coax cable 116 may be reduced from 50 ohms at the feed location in the matching section 130 due to the design and inclusion of the matching section 130. As described herein, the impedance is reduced from 50 ohms to approximately 34 ohms.

Reduced diameter dielectric material layer 134 may be provided in multiple ways. According to one aspect, a standard coax cable 16 may be provided and may be modified such that the outer shield 22 dielectric material and dielectric material layer 20 may be removed therefrom for a length equal to the sum of heights H3 and H5, leaving the center conductor 18 exposed. A separate reduced diameter dielectric material layer 134 may then be provided as a separate piece or portion of dielectric material 134. According to this aspect, the dielectric material layer 120 and reduced diameter dielectric material layer 134 may be the same material, for example, Teflon, but may be provided as two separate pieces and connected together within fitting 124.

According to another aspect, a standard coax cable 16 may be provided and then shield layer 22 and dielectric material layer 20 may be removed for a distance equal to height H3 while the shield layer 122 may also be removed across the matching section 130. The dielectric material layer 120 may then be trimmed to form the reduced diameter dielectric material layer 134 for the height H5 of matching section 130.

Thus, in general terms, it will be understood that center conductor 18, 118 of coax cable 16, 116 may remain unchanged regardless of the implementation thereof and shield layer 122 of coax cable 116 may be removed for the height equal to the height H3 of cone 114 as well as height H5 of matching section 130. According to the first aspect, dielectric material layer 120 may likewise be removed for the height H3 of cone 114 and the height H5 of matching section 130 or alternatively, according to the second aspect, may be removed for the height H3 of cone 114 and trimmed to reduce the diameter thereof for the height H5 of matching section 130.

According to another aspect, matching section 130 may be modified to include an increased diameter center conductor 118 to effectively reduce the impedance relative to the impedance of coax cable 116.

Figure 3C:
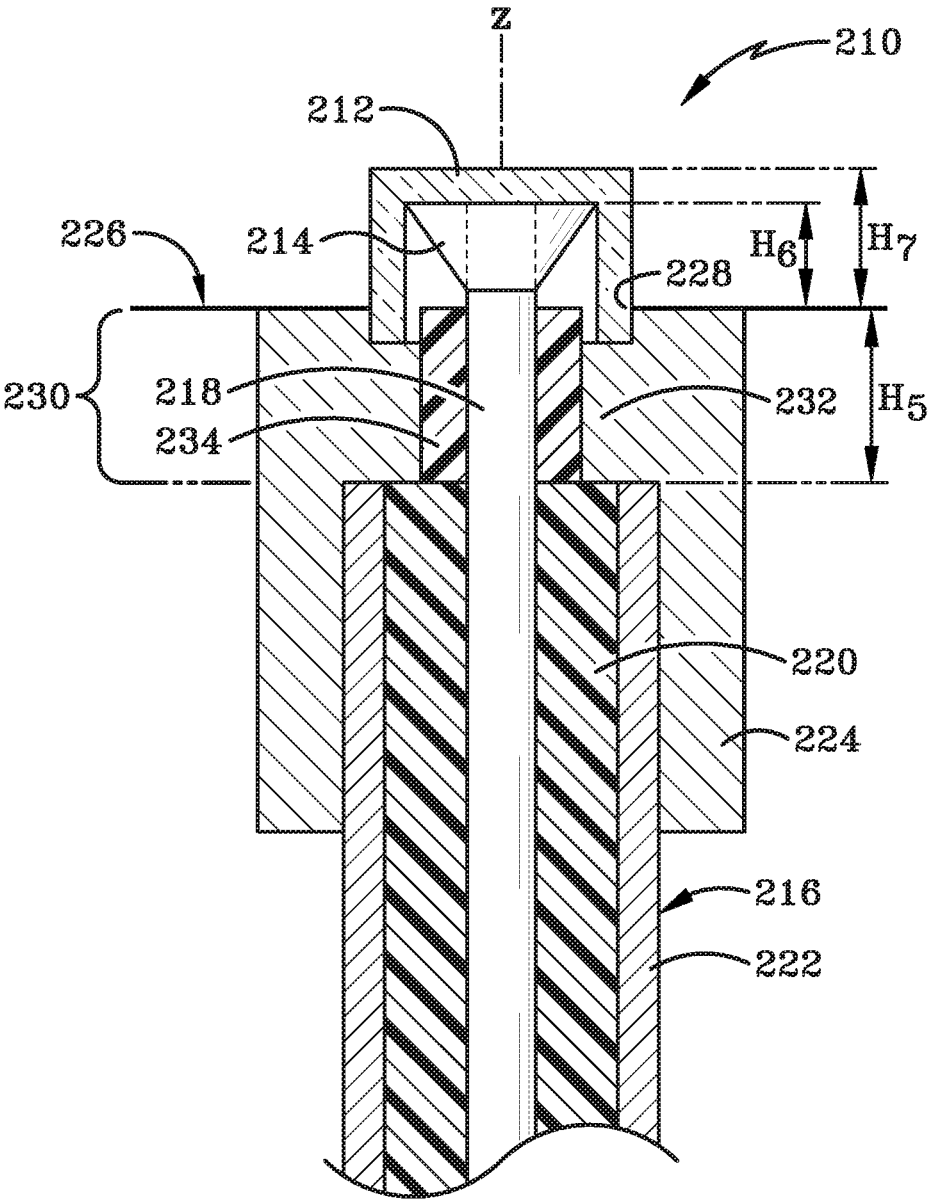
FIG. 3C is a front elevation cross-sectional view of a second embodiment of a modified monocone antenna according to one aspect of the present disclosure.

With reference to FIG. 3C, an alternative modified monocone antenna is shown and generally indicated at reference 210. Antenna 210 may be substantially identical to antenna 110 in that it may include all the features and components as discussed with antenna 110, including matching section 230 having height H5. Antenna 210 may differ from antenna 110; however, in that the height H6 of cone 214 and the height H7 of cone 214 with radome 212 may be reduced relative to height H3 of cone 114 and height H4 of cone 114 with radome 112. Each of these configurations may provide substantial performance improvements over a standard monocone antenna 10, as discussed below.

Figure 4:
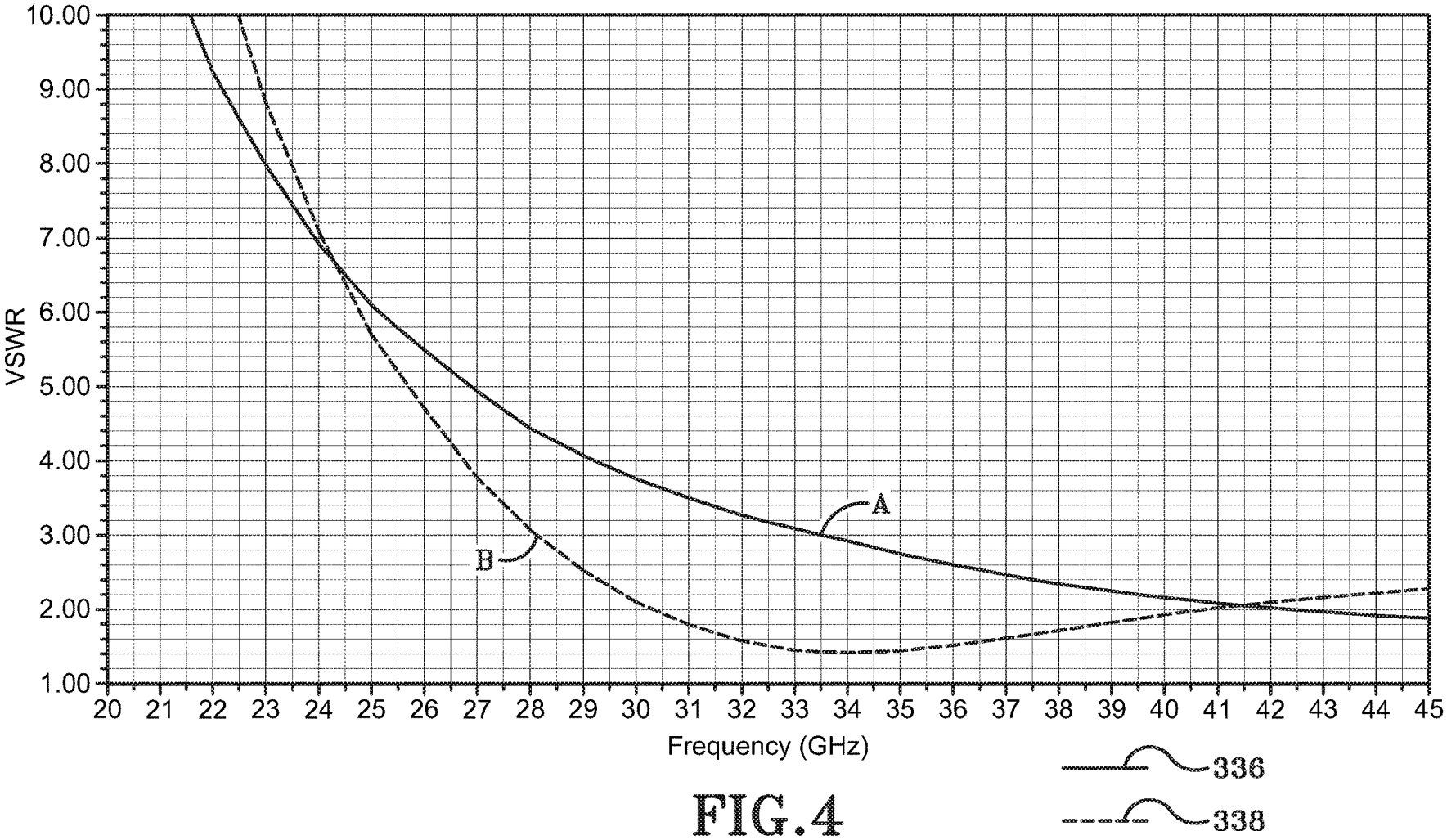
FIG. 4 is a graphical representation of the effect of the modifications to the monocone antenna of FIG. 2B on the operational frequency thereof according to one aspect of the present disclosure.

With reference to FIGS. 2B, 3B, 4 and 5, the operational advantages of the impedance matching section 130 of antenna 110 will now be discussed. Antenna 110 may have the same physical size of a similar antenna 10 in that the physical size of cone 114 and radome 112. More particularly, the height H3 of cone 114 and height H4 of cone 114 with radome 112 may be substantially identical to the heights H1 and H2 of cone 14 and cone 14 with radome 12, respectively. In utilizing matching section 130 with the same cone height (i.e. H1=H3) above the ground plane 126 as used with monocone antenna 10, a frequency shift is shown such that antenna 110 may be operated at a frequency of up to 16.1 percent lower than a standard monocone antenna 10 of the same physical size. This frequency shift is best illustrated in FIG. 4 which provides a graph of the voltage standing wave ratio (VSWR), as indicated on the Y axis, relative to the operational frequency provided on the X axis. In the graph of FIG. 4, the solid line at reference 336 represents the VSWR to frequency characteristics of a standard monocone antenna such as monocone antenna 10. The dashed line indicated at reference 338 represents the VSWR to frequency of monocone antenna 110 having impedance matching section 130 as discussed herein. For proper comparison, a VSWR ratio of 3:1 is used. This ratio of 3:1 VSWR to frequency is an industry standard measurement of effectiveness of an antenna wherein a higher VSWR ratio represents a less effective antenna configuration. Using this 3:1 industry standard VSWR ratio, the graph in FIG. 4 then shows that the standard monocone antenna 10 operates at a 33.5 GHz frequency, indicated at point A. By comparison, monocone antenna 110 meets this industry standard ratio of 3:1 at the lower frequency of 28.1 GHz, indicated at point B. This represents a 5.4 GHz shift in frequency between monocone antenna 10 and monocone antenna 110 with matching section 130 having the same physical size (as used for the graph in FIG. 4 heights H2, H4, and H5 all equal 0.05 inches) such that monocone antenna 110 may be operated at a frequency that is 5.4 GHz lower than monocone antenna 10. This 5.4 GHz shift, as compared to the original 33.5 GHz operational frequency low of monocone antenna 10 represents a 16.1 percent frequency shift, i.e. the operable 3:1 VSWR bandwidth is extended 16.1 percent lower in frequency for monocone antenna 110 relative to monocone antenna 10.

Figure 5:
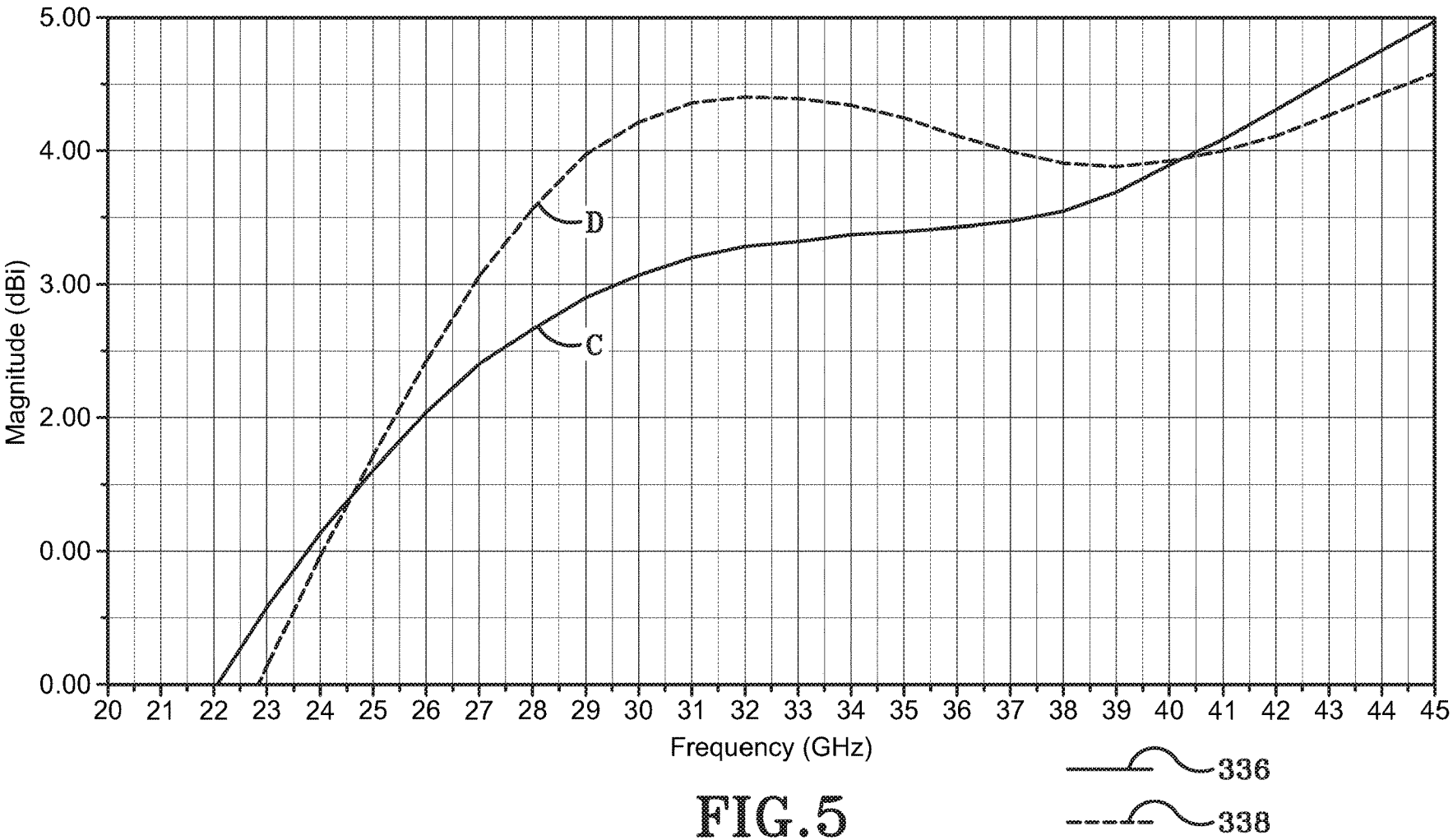
FIG. 5 is a graphical representation of the effect of the modifications to the monocone antenna of FIG. 2B on the antenna gain thereof according to one aspect of the present disclosure.

Additionally, with reference to FIG. 5, the gain of monocone antenna 110 is increased at the same frequencies relative to monocone antenna 10. Specifically, as shown in the graph in FIG. 5, the magnitude (in dBi, decibels with respect to isotropic) of each antenna 10 and 110 is shown relative to the operating frequency, with the solid line indicated at 336 representing the gain of monocone antenna 10 and the dashed line at reference 338 representing the gain of monocone antenna 110 with matching section 130. Looking at a frequency of 28.1 GHz, which is the same frequency where the 3:1 VSWR ratio is achieved by monocone antenna 110 with matching section 130, provides that the gain for monocone antenna 10 is approximately 2.7 dBi (indicated at point C) while the gain for monocone antenna 110 with matching system 130 is approximately 3.7 dBi (indicated at point D). This represents a 1 dB higher gain for monocone antenna 110 with matching section 130 relative to monocone antenna 10 without a matching section therein. A similar gain increase of approximately of 1 dB is seen at the 33.5 GHz frequency where the 3:1 VSWR ratio is achieved by monocone antenna 10. As with the graph in FIG. 4, the implementation utilized for the test represented by the graph in FIG. 5 were monocone antennas 10 and 110 having the same physical size with heights H2, H4, and H5 equal to 0.05 inches.

Accordingly, it is understood that the inclusion of matching section 130 with monocone antenna 110 provides the advantage of lowering the operational frequency of a monocone antenna without making modifications or increasing the size thereof. This is particularly advantageous where a lower operational frequency is desired but physical constraints such as location, size, aerodynamics, or the like prevent or otherwise impede the ability to increase the size of the cone 114. Thus, matching section 130 may be included to maintain an established physical size while still allowing up to a 16.1 percent reduction in lower operational frequency. In addition, this may allow for the inclusion of a matching section 130 with legacy systems without significant modification costs or redesign in that a legacy system using a monocone antenna, such as monocone antenna 10, may be readily adapted to include a matching section 130 therein, thus allowing legacy systems to be operated with a lower operational frequency, as desired.

Figure 6:
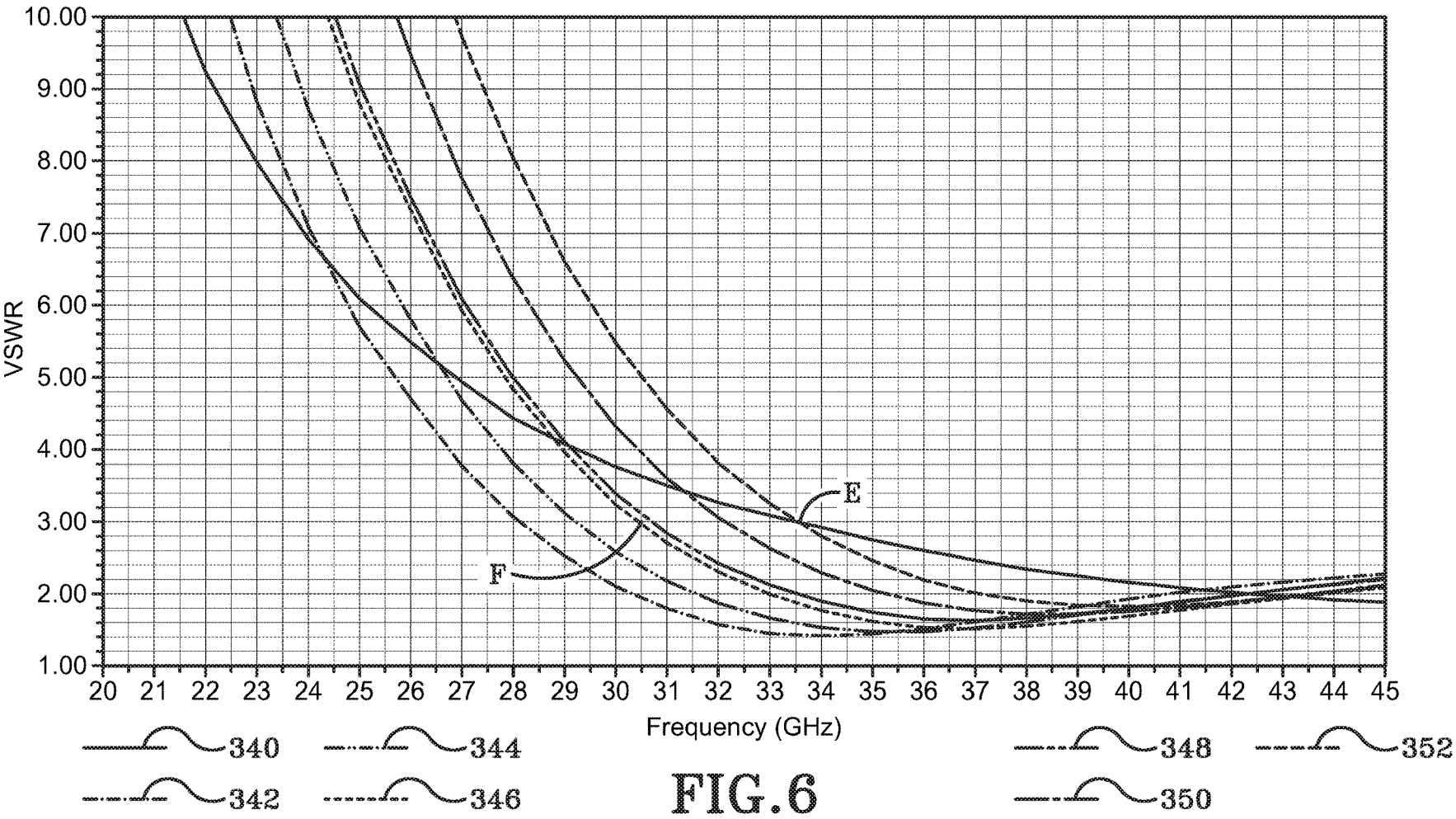
FIG. 6 is a graphical representation of the effect of various modifications to the monocone antenna of FIG. 3C on the operational frequency thereof according to one aspect of the present disclosure Similar numbers refer to similar parts throughout the drawings.

With reference to FIGS. 3C and 6, the operational advantages of a reduced height cone 214 and radome 212 when paired with matching section 230 will now be discussed. As discussed above, matching section 130 in a monocone antenna 110 with the same physical size as a non-modified monocone antenna 10 may provide advantages of shifting the operational frequency to the lower end of the spectrum. Alternatively, in applications and implementations where it is advantageous to maintain the same operational frequency but to reduce the size of the monocone antenna 210 with matching section 230 may be provided or implemented. With reference to FIG. 6, the VSWR to frequency ratio of various size configurations is shown and provided. Specifically, as shown in the graph in FIG. 6, the solid line at reference 340 represents a monocone antenna configured such as monocone antenna 10 (as seen in FIG. 2A) wherein height H2 is 0.05 inches and height H1 is 0.04 inches. In this configuration, as previously discussed, the antenna hits the desired 3:1 VSWR to frequency ratio at a 33.5 GHz operational frequency, indicated at point E.

The other lines in FIG. 6 represent a modified antenna configuration, such as antenna 210, wherein height H7 is reduced relative to height H2 and height H6 is likewise reduced relative to height H1. Specifically, the following test dimensions were used:

- The dash-dot line at reference 342, height H6 is equal to 0.035 inches and height H7 is equal to 0.045 inches;
- the dash-dot-dot line at reference 344, height H6 is 0.033 inches and height H7 is 0.043 inches;
- the small dashed line at 346, height H6 is 0.031 inches and height H7 is 0.041 inches;
- the long dash, double short dash line at reference 348, height H6 is 0.029 inches and height H7 is 0.039 inches;
- the long dash short dash line at 350, height H6 is 0.027 inches and height H7 is 0.037 inches; and
- the dashed line at 352, height H6 is 0.025 inches and height H7 is 0.035 inches.

It is this final dashed line, at reference 352, that hits the desired 3:1 VSWR to frequency ratio at 33.5 MHz (point E), thus representing that the size of cone 214 and radome 212 may be reduced from a 0.05 inch overall height, i.e. height H2, to a 0.04 inch overall height, i.e. H7, while maintaining the same operational frequency of 33.5 MHz.

Accordingly, the overall height H7 of monocone antenna 210 with radome 212 may be reduced by up to 20 percent while maintaining the same operational frequency performance as unmodified antenna 10 without matching section 230. The graph in FIG. 6 further indicates that in implementations where it is desirable to both reduce the physical size of an antenna and lower the operational frequency thereof, antenna sizes with heights H6 and H7 intermediate of that 20 percent reduction may provide a lower operational frequency and reduced physical sized antenna. By way of one non-limiting example, the overall height may be reduced 10 percent from 0.05 inches to 0.045 inches while lowering the operational frequency to approximately 30.5 GHz. This example would fall between the lines 346 and 348 as indicated and shown at reference point F in FIG. 6. This example provides that the overall height H7 may be reduced 10 percent while simultaneously reducing the operational frequency by approximately 9 percent. Thus, it is possible to realize both a reduction in physical size and a lowered operational frequency simply by implementing matching section 130 and/or 230 into a monocone antenna as discussed herein.

Although discussed herein with relation to monocone antennas, similar beneficence and improvements may be realized when a matching section is provided for monopole antennas. Specifically, the inclusion of a matching section such as matching section 130 and/or 230 with a monopole antenna may provide an improvement to monopole antenna performance at a low end of the operational band. This improvement has been seen to be up to and approximately an 11 percent downward frequency shift. Similarly, the inclusion of a matching section in a monopole antenna may provide other benefits such as frequency gain or the like. It will be further understood that a matching section providing a reduced impedance feed to other antennas may provide similar benefits and/or improvements in operation and performance for other antenna types.

While discussed herein as a reduced size, but otherwise identical, dielectric material, it will be understood that the matching section may change the characteristics of the feed to provide the same or similar benefits in other ways. According to one non-limiting example, a matching section may be provided with a different dielectric material that can change the feed from 50 ohms to 34 ohms. According to another non-limiting example, a separate connector may be utilized that may allow for a coax cable to be fed into one side thereof, while a matching section is provided within the connector to shift the feed impedance down relative to the coax cable, for example to 34 ohms, as discussed herein.

It will be further understood that matching sections having different reduced diameter dielectric material may provide similar benefits. By way of one non-limiting example, reducing the dielectric material layer in a matching section to 0.076 inches may provide some similar benefits, although likely with a different degree of success. According to another non-limiting example, a matching section with stepped down dielectric material layers may be provided to realize similar benefits in a similar system. Accordingly, it will be understood that the present disclosure is provided as exemplary matching section and antenna configurations, and not a limiting example thereof.

It will be further understood that other methods or configurations may be employed to reduce the impedance of the feed relative to the impedance of the coax cable. According to one non-limiting example, the center conductor may be increased in diameter within the matching section of a monocone antenna to reduce the impedance of the feed. According to this aspect, the outer diameter of the matching section may remain constant with the rest of coax cable while the center conductor may increase in diameter as it extends through the matching section. Accordingly, it will be understood that the benefits of reduced physical size, lower operational frequency, or both, may be realized in a monocone (or monopole) antenna as discussed herein through any suitable means provided that the impedance of the feed is reduced relative to the impedance of the coaxial cable via a matching section having a height approximately equal to one-quarter wavelength of the operational frequency.

In operation, modified monocone antennas 110 and/or 210 may be operated normally in that they may be used for receiving and/or transmission of RF signals according to normal antenna operations as dictated by the desired implementation. However, it will be understood that the operational frequency and/or size may be lowered or reduced relative to current monocone antenna implementations such as antenna 10 without changing or otherwise modifying the methods of operation thereof.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A monocone antenna comprising:

a coaxial cable having a center conductor, a dielectric material layer surrounding the center conductor, and a shield layer surrounding the dielectric material layer;

an antenna cone connected to an end of the center conductor;

a radome over the antenna cone, the radome having a first height as measured from a ground plane to a top of the radome; and a matching section with a shield layer disposed between the coaxial cable and the antenna cone and having a reduced diameter dielectric material layer with the center conductor in electrical connection with the antenna cone, the matching section having a second height.

2. The monocone antenna of claim 1 wherein the first height and the second height are equal and are approximately one-quarter wavelength of an operational frequency of the monocone antenna.

3. The monocone antenna of claim 2 wherein the operational frequency of the monocone antenna is lower relative to a standard monocone antenna without the matching section having same dimensions.

4. The monocone antenna of claim 3 wherein the operational frequency of the monocone antenna is up to 16.1 percent lower.

5. The monocone antenna of claim 1 wherein the coaxial cable has a characteristic impedance of about 50 ohms and a feed of the center conductor at the antenna cone has a characteristic impedance of about 34 ohms.

6. The monocone antenna of claim 5 wherein the dielectric material layer of the coaxial cable has a first diameter and the reduced diameter dielectric material layer in the matching section has a second diameter that is approximately 30 percent smaller than the first diameter.

7. The monocone antenna of claim 1 wherein the dielectric material layer of the coaxial cable and the reduced diameter dielectric material layer of the matching section are constructed of different dielectric materials.

8. The monocone antenna of claim 1 wherein the first height is less than the second height and wherein the second height is approximately one-quarter wavelength of an operational frequency of the monocone antenna.

9. The monocone antenna of claim 8 wherein the first height is reduced while maintaining the same operational frequency relative to a standard monocone antenna without a matching section.

10. The monocone antenna of claim 9 wherein the first height is reduced by up to 20 percent.

11. The monocone antenna of claim 8 wherein the coaxial cable has a characteristic impedance of 50 ohms and a feed from the matching section to the antenna cone has a characteristic impedance of about 34 ohms.

12. The monocone antenna of claim 11 wherein the dielectric material layer in the coaxial cable has a first diameter and the reduced diameter dielectric layer in the matching section has a second diameter that is approximately 30 percent smaller than the first diameter.

13. The monocone antenna of claim 8 wherein the dielectric material layer in the coaxial cable and the reduced diameter dielectric material layer in the matching section are constructed of different dielectric materials.

14. A monocone antenna comprising:

a coaxial cable having a center conductor, a dielectric material layer surrounding the center conductor, and a shield layer surrounding the dielectric material layer;

an antenna cone connected to an end of the center conductor;

a matching section between the coaxial cable and the antenna cone with the center conductor in electrical connection with the antenna cone and having a reduced diameter dielectric material layer and first height that is equal to one-quarter wavelength of an operational frequency of the monocone antenna; and a radome over the antenna cone, the radome having a second height as measured from a ground plane to a top of the radome, wherein the second height is less than the first height; and wherein the monocone antenna has a lower operational frequency than a standard monocone antenna.

15. The monocone antenna of claim 14 wherein the second height is reduced by up to 10 percent relative to the first height.

16. The monocone antenna of claim 15 wherein the operational frequency of the monocone antenna is up to 9 percent lower.

17. The monocone antenna of claim 15 wherein the second height is 10 percent reduced relative to the first height and the operational frequency of the monocone antenna is approximately 9 percent lower.

18. The monocone antenna of claim 14 wherein the coaxial cable has a characteristic impedance of about 50 ohms and a feed of the center conductor at the antenna cone has a characteristic impedance of about 34 ohms.

19. A monocone antenna comprising:

a coaxial cable having a center conductor, a dielectric material layer surrounding the center conductor, and a shield layer surrounding the dielectric material layer;

an antenna cone connected to an end of the center conductor;

a radome over the antenna cone; and a matching section having a height that is equal to one-quarter wavelength of an operational frequency of the monocone antenna and having a reduced impedance relative to an impedance of the coaxial cable.

20. The monocone antenna of claim 19 wherein the coaxial cable impedance is approximately 50 ohms and the matching section impedance is approximately 34 ohms.

* * * * *